United States Patent [19]

Petritsch

[11] 3,996,044

[45] Dec. 7, 1976

[54] ELECTRO-PYROLYTIC UPRIGHT SHAFT TYPE SOLID REFUSE DISPOSAL AND CONVERSION PROCESS

[75] Inventor: Josef Peter Petritsch, Glen Iris, Australia

[73] Assignees: Intercont Development Corporation Pty. Ltd., Melbourne; Plant-Fab Construction & Installations Pty. Ltd., Morwell, both of Australia

[22] Filed: Jan. 10, 1975

[21] Appl. No.: 540,272

[30] Foreign Application Priority Data

Jan. 23, 1974 Australia ..... 6345/74

[52] U.S. Cl. ..... 75/10 R; 48/209; 75/44 S

[51] Int. Cl.[2] ..... C22D 7/00

[58] Field of Search ..... 75/10 R, 63, 44 S, 20 R; 266/33 S; 48/209

[56] References Cited

UNITED STATES PATENTS

| | | | |
|---|---|---|---|
| 3,471,275 | 10/1969 | Borggreen | 48/209 |
| 3,697,256 | 10/1972 | Engle | 75/40 |
| 3,812,620 | 5/1974 | Titus et al. | 75/44 S |
| 3,850,588 | 11/1974 | White | 48/209 X |

*Primary Examiner*—M. J. Andrews
*Attorney, Agent, or Firm*—Cushman, Darby & Cushman

[57] ABSTRACT

Waste material is disposed of and its usable constituents recovered by feeding the waste material downwardly through a vertical shaft in which its temperature is progressively raised thereby driving off volatile matter and thermally degrading appropriate portions of the material to provide a gaseous discharge suitable for use as a fuel. Material such as metal and other non-volatilizable substances eventually reach a furnace chamber which has a temperature of at least 1600° C where they are liquified and tapped from the chamber. The heavier metal component is tapped from a point lower than the point at which other liquid residues are tapped to enable the metal to be recycled.

7 Claims, 2 Drawing Figures

Figure 1:
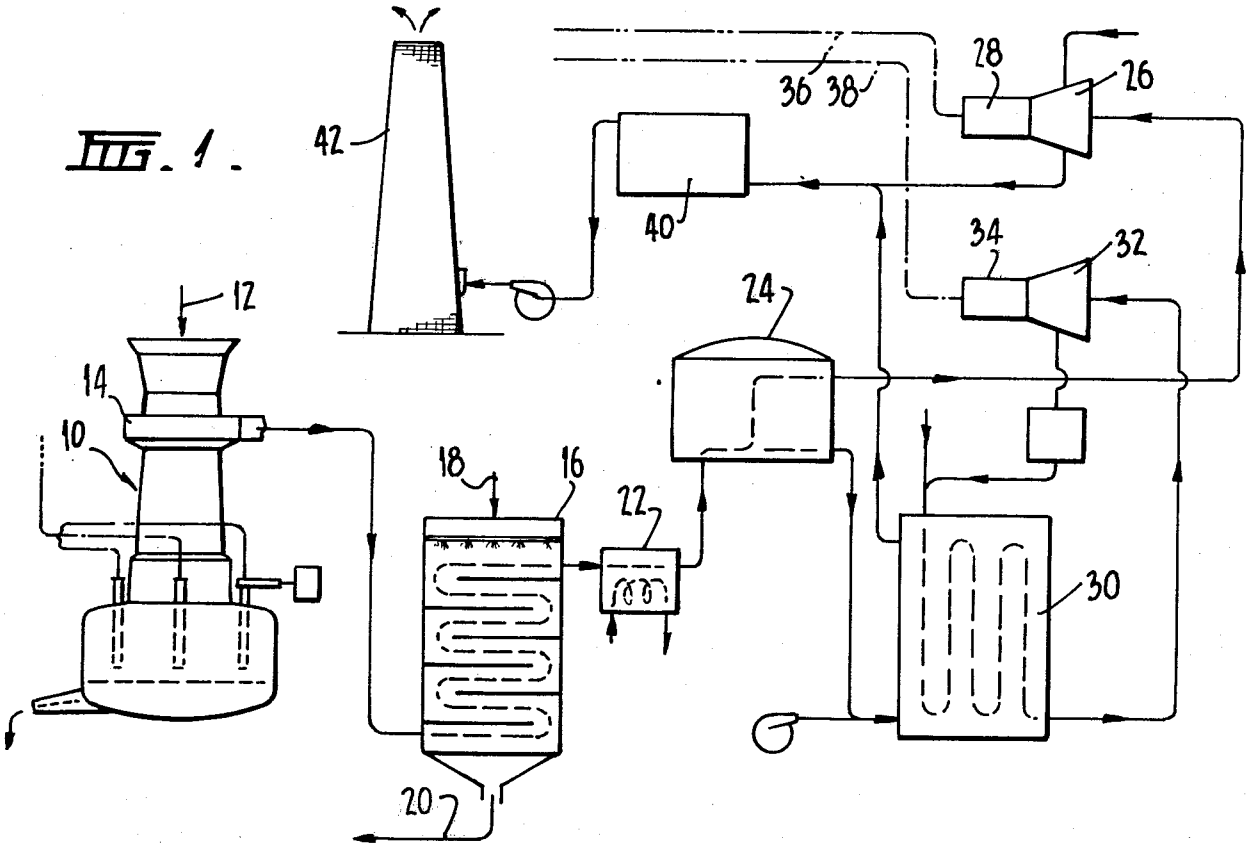

ELECTRO-PYROLYTIC UPRIGHT SHAFT TYPE SOLID REFUSE DISPOSAL AND CONVERSION PROCESS

This invention relates to the processing of solid waste materials such as those generated in urban communities and in a wide range of industries. Such waste materials include various metallic, mineral and organic components some of which contain moisture and various vaporizable or volatile constituents.

The disposal of waste materials has become a worldwide problem and is causing a considerable degree of concern to health authorities and to environmentalists. The dwindling number of sites available for the safe disposal of refuse by land fill has in recent years led to the search for some other and more efficient means of disposal of waste matter.

A shortage of raw materials has also led to the search for means of recovering as much as possible of the usable material in waste matter. Some of the solutions to the problem have included incinerating, shredding, compacting, composting and recycling. All of these are however only a partial solution to the problem.

The incineration of waste materials effectively disposes of those materials, but introduces an atmospheric pollution problem. Additionally the residue from incineration still represents up to 45% of the original weight and between 10% and 25% of the original volume of the crude refuse.

It is an object of the present invention to produce a waste disposal system in which air pollution is minimised, which enables usable waste components to be recovered and which effectively uses the latent heat energy available in the material to be treated.

With this in view the invention provides a process for treating waste materials comprising the steps of: progressively supplying the waste materials to the upper end of an upright chamber or shaft and allowing or causing the material to progressively descend through said upright chamber in an oxygen deficient atmosphere so that its temperature is progressively increased while successively passing through, a pre-drying zone in which moisture and other vaporisable and volatile constituents are driven off together with gaseous reaction products, a pyrolytic reaction zone in which the material is subjected to thermal degradation and further gaseous products are produced, and a final sinter and smelting zone in which metallic and mineral residues are melted in a furnace chamber maintained at a temperature of the order of at least 1600° C and collected in an electrically conductive bath of molten material maintained in the furnace chamber, wherein the required temperature is initially produced in the furnace chamber by one or more arcs struck between the electrically conductive bath and electrodes arranged thereabove, wherein excess molten metallic and refractory material is progressively discharged from the crucible, wherein the heat generated by the operation is supplemented when and if necessary by said arc or arcs, and wherein the gaseous and/or volatile constituents produced or released by the process are collected for use as a fuel.

Preferably the molten metal and slag which accumulate in the base of the furnace chamber are removed either continuously or in intermittent tapping operations. The gaseous and/or volatile discharge may be cleaned in an appropriate scrubber and applied to useful purposes such as the fueling of a gas turbine to drive an electric generator, or the firing of a boiler to produce steam to drive a turbine connected to an electrical generator.

Figure 2:
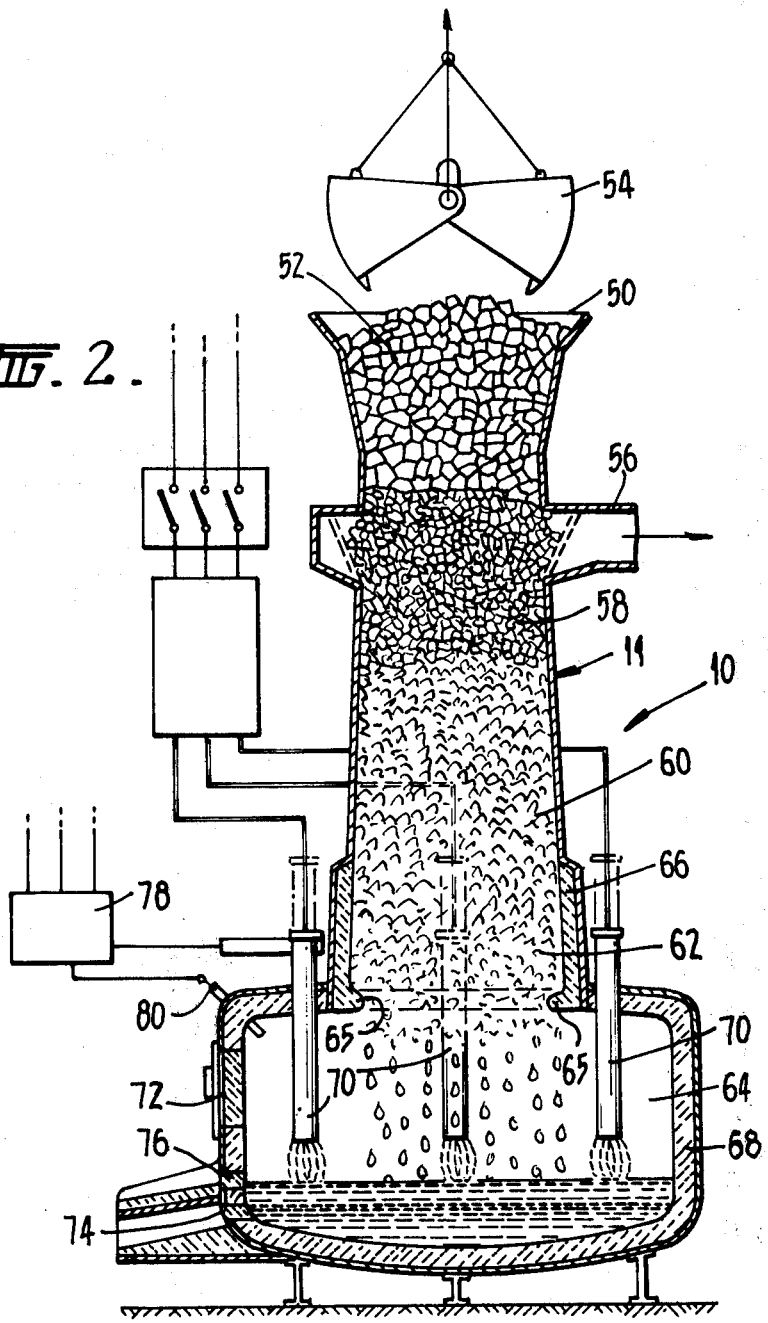

In order that the invention may be more readily understood it will now be described by way of example with reference to the accompanying drawings in which:

FIG. 1 is a diagrammatic representation of a waste disposal system according to the invention, and FIG. 2 is a diagrammatic view of a furnace for use in the practice of the invention.

FIG. 1 illustrates an upright furnace 10 which is fed with waste materials, through an upper opening, in the direction of the arrow 12. Gaseous and/or volatile products are collected in a duct 14 which surrounds the furnace chamber 10 and are delivered to a scrubber 16 which is fed with water through a pipe 18.

Sludge is removed from the base of the scrubber 16 through pipe 20 and the cleaned gas is discharged to a dryer 22 and thence to a storage tank 24. The gas at this stage consists almost exclusively of carbon monoxide (CO) and hydrogen ($H_2$) in almost equal parts, and has a calorific value of approximately 3000 kcal per kg of crude refuse. It is therefore a valuable fuel which may be used directly in a gas turbine 26 to drive an electrical generator 28 or as a fuel for a boiler 30 producing steam to drive a steam turbine 32 connected to an electrical generator 34.

Other possibilities are that the gas can be used for heating purposes, air conditioning or industrial application in processing industries.

The power generated by the generators 28 and 34 is fed through power lines 36 and 38 to the public grid system and/or is used to power the furnace as will be further described hereinafter, and to power the various pieces of auxiliary equipment required for the operation of the plant.

The gas is discharged from the boiler 30 and/or from the gas turbine 26, through a flue gas purification plant 40 to a chimney stack 42 for dispersion of the gaseous emissions to the atmosphere. At this stage the gas is inoffensive and contains a negligible percentage of pollutants as compared with the emission from a conventional incinerator.

Referring now to FIG. 2, it will be seen that the upright furnace 10 has a shaft 11 with an open mouth 50 into which waste material 52 may be fed by means of a grab 54 or any other suitable means. The upper part of the furnace tapers downwardly to form a hopper for the waste material deposited therein. Below the hopper there is provided a gas collecting duct 56 surrounding the shaft and connected to the interior of the shaft by means of a number of relatively small apertures.

Below the gas collection duct there is a predrying zone 58 and below that again a pyrolytic reaction zone 60 in which thermal degradation of the refuse takes place. Below this is a sinter and smelting zone 62 in which metal and mineral refuse components are melted down into a fluid mass which accumulates at the bottom of the furnace chamber 64. A lip 65 around the base of the shaft 11 regulates the flow of material into the furnace chamber 64.

The smelting zone 62 and the furnace chamber 64 are provided with refractory linings 66 and 68 respectively. Three electrodes 70 or a multiple thereof extend downwardly into the furnace chamber 64 which is of larger diameter than the shaft. Each of the electrodes 70 is connected to one phase of a three-phase power supply to provide a balanced system. An access door 72 is provided in the furnace chamber as well as tap holes 74 and 76 for the discharge of molten metals and fused slag respectively. The tap hole for the fused slag is at a higher level than the tap hole for the molten metals.

The electrodes 70 are adjustable in height by means of a regulating mechanism 78 controlled by a thermal sensing element 80 which extends into the furnace chamber 64. The distance of the ends of the electrodes from the conductive surface of the smelting bath and the amperage applied to the electrodes determines the intensity of the heat within the furnace chamber 64.

To facilitate the initial start-up of the process the first charge preferably consists predominantly of metal cans and/or other metal scrap. Following this the shaft is filled with unselected refuse from the various sources to be serviced by the plant. The power circuit to the electrodes is closed, the electrodes are energised and the electric arcs are struck. This has the effect of raising the temperature in the furnace chamber until a temperature of approximately 1600° C is reached, at which stage all of the metal in the furnace chamber is melted to form a conductive bath.

The sensor 80 and the regulating mechanism 78 operate to move the electrodes closer to the surface of the bath to maintain a constant temperature in the furnace chamber. The heat from the chamber travels upwardly through shaft 60 to heat the smelting zone 62, the pyrolytic reaction zone 60, and the pre-drying zone 58. The temperature in each of these zones will be lower than that in the zone below it.

Since the area below the gas collection duct 56 is substantially sealed from the atmosphere the process takes place in an oxygen-deficient environment and therefore complete oxidation of the waste material is prevented. The heat from the furnace chamber drives off moisture and some of the volatiles in the pre-drying zone while less volatile materials are driven off as the refuse progresses further down the shaft. The pyrolytic degradation of the material generates further gases all of which stream upwardly through the shaft to duct 56. A pressure slightly below atmospheric is applied to duct 56 to draw off the water vapour and gases.

In the general case it will not be necessary to seal the mouth 50 of the shaft because the waste material itself provides an effective seal. In some cases however a cover, sluice gate or other closure may be required.

To keep the process operative further supplies of refuse are fed to the shaft either intermittently or continuously, and the electric arcs in the furnace chamber are used as required to maintain the temperature in the chamber. In some cases the nature of the refuse is such that the electrodes can be dipped into the molten bath to give a submerged arc with a consequent saving on power consumption.

In the pyrolytic and/or smelting zones the carbon in the refuse reacts on a stoichiometric basis with oxygen which is mainly derived from the natural moisture content of the charge.

In the case of relatively dry refuse it may be necessary or desirable to inject moisture into the high temperature region. Preferably the injection of moisture takes place in the furnace chamber so that the vapour can percolate upwardly through the charge reacting with released carbon as it progresses.

In the sinter and smelting zone gasification of organic refuse components is completed and any inorganic components are fused and melted into metals, which accumulate at the bottom of the furnace chamber, and fluid slag which is lighter and floats on top of the metal bath. The molten metal and slag discharged from the furnace chamber may be poured into water-filled quench troughs where they form granulated residues. These are of substantially uniform consistency and appearance and can be used for further commercial exploitation.

The molten metals may also be cast into ingots which are returned to the steel making industry.

The arcs used for heating the furnace chamber have no need of any gaseous combustion medium or any gaseous or liquid fuel and therefore provide ideal conditions for the pyrolytic thermal degradation process of the invention.

It will be seen that the invention provides a total refuse conversion system leaving residues which are only 3% to 6% by volume and 15% to 20% by weight of the original crude refuse.

The claims defining the invention are as follows:

1. A process for treating waste materials containing moisture and metallic, mineral and organic components at least some of which contain vaporizable or volatile constituents, said process comprising: maintaining a molten electrically conductive pool of metal and mineral components in a furnace chamber located in the lower end of an upright shaft furnace by passing an electric arc between the pool and at least one electrode so as to heat the chamber to at least 1600° C; supplying the waste materials to the upper end of an upright shaft which has a lower end in communication with the furnace chamber at a location above the surface of the pool, said shaft having a gas outlet located above its lower end, said furnace chamber and the portion of said shaft below the gas outlet being substantially sealed from the outside atmosphere so that an oxygen deficient atmosphere exists in the chamber and in said shaft; passing heat from the chamber into the lower end of said shaft and upwardly therethrough while passing the waste materials downwardly through said shaft so that the temperature of the waste materials is progressively increased as the waste materials descend through the shaft, the waste materials undergoing in sequence as they descend a pre-drying treatment during which at least some vaporizable or volatile constituents and moisture are driven off, a pyrolytic treatment during which thermal degradation of organic components occurs in the oxygen-deficient atmosphere thereby producing gaseous products which flow upwardly in said shaft and a sintering and smelting reaction during which gasification of any remaining organic components is essentially completed so that essentially only metallic and mineral components remain; and passing the metallic and mineral components through the lower end of the shaft into the molten pool; discharging excess molten metallic and mineral components from the furnace chamber; and discharging gaseous products from said shaft through the gas outlet at a location above the location of the pyrolysis reaction.

2. A process as in claim 1 wherein the sintering and smelting reaction melts the metallic and mineral components which then pass in molten form into the furnace chamber.

3. A process as in claim 1 wherein the molten pool is provided initially by charging the furnace chamber with metallic components and establishing an arc between the latter and at least one electrode.

4. A process as in claim 1 including applying a negative pressure to the gas outlet to remove gaseous products from the shaft.

5. A process as in claim 4 including scrubbing the gaseous products for use as a fuel.

6. A process as in claim 1 including monitoring the temperature in the furnace chamber and varying a gap between the electrodes and the pool to maintain the temperature in the furnace chamber substantially constant.

7. A process as in claim 1 including injecting moisture into the furnace chamber to enable carbon in the organic component of said waste materials to react on a stoichiometric basis with oxygen present in the waste materials and in the injected water to form carbon monoxide.

* * * * *